US009453344B2

(12) United States Patent
Hall et al.

(10) Patent No.: US 9,453,344 B2
(45) Date of Patent: Sep. 27, 2016

(54) MODULAR INSULATED FACADE

(71) Applicant: David R. Hall, Provo, UT (US)

(72) Inventors: David R. Hall, Provo, UT (US); Benjamin J. Jensen, Orem, UT (US); Clayton Kimball, Holiday, UT (US); Daniel P. Nelson, Alpine, UT (US)

( * ) Notice: Subject to any disclaimer, the term of this patent is extended or adjusted under 35 U.S.C. 154(b) by 0 days.

(21) Appl. No.: 14/702,639

(22) Filed: May 1, 2015

(65) Prior Publication Data

US 2015/0315796 A1 Nov. 5, 2015

Related U.S. Application Data

(60) Provisional application No. 61/987,077, filed on May 1, 2014.

(51) Int. Cl.

| | |
|---|---|
| ***B44F 7/00*** | (2006.01) |
| ***B44F 9/00*** | (2006.01) |
| ***E04C 1/00*** | (2006.01) |
| ***E04F 13/08*** | (2006.01) |
| ***E04F 13/075*** | (2006.01) |
| ***E04B 1/76*** | (2006.01) |

(52) U.S. Cl.

CPC ..... *E04F 13/0875* (2013.01); *E04B 1/762* (2013.01); *E04B 1/7625* (2013.01); *E04F 13/075* (2013.01); *E04F 13/0866* (2013.01); *E04F 13/0871* (2013.01); *E04F 2203/02* (2013.01); *E04F 2290/00* (2013.01)

(58) Field of Classification Search

CPC ..... E04F 13/075; E04F 2203/02; E04F 2290/04; E04B 1/762; E04B 1/7625

See application file for complete search history.

(56) References Cited

U.S. PATENT DOCUMENTS

| | | | | |
|---|---|---|---|---|
| 3,251,168 | A * | 5/1966 | Waring | E04F 13/0803 52/235 |
| 3,590,540 | A * | 7/1971 | Johnson et al. | 52/309.13 |
| 4,478,018 | A * | 10/1984 | Holand | 52/220.1 |
| 4,593,511 | A * | 6/1986 | Hakasaari | 52/404.4 |
| 5,218,798 | A * | 6/1993 | Bentivegna et al. | 52/206 |
| 5,410,852 | A * | 5/1995 | Edgar et al. | 52/408 |
| 5,743,057 | A * | 4/1998 | Martin | 52/457 |
| 6,148,896 | A * | 11/2000 | Pinto et al. | 160/229.1 |
| 6,931,809 | B1 * | 8/2005 | Brown et al. | 52/409 |
| 7,762,040 | B2 * | 7/2010 | Wilson et al. | 52/748.1 |
| 8,402,705 | B2 | 3/2013 | Petersen | |
| 8,567,140 | B2 | 10/2013 | Wagner | |
| 8,572,918 | B1 * | 11/2013 | Zhou et al. | 52/407.4 |
| 8,695,308 | B2 | 4/2014 | Falk et al. | |
| 8,789,339 | B2 | 7/2014 | Di Scola | |
| 8,984,830 | B2 | 3/2015 | Wieleba | |
| 2001/0054264 | A1 * | 12/2001 | Votolato et al. | 52/263 |

(Continued)

*Primary Examiner* — Brian Mattei
*Assistant Examiner* — Gisele Ford

(57) ABSTRACT

A method for insulating and imparting a desired architectural style to a building or other structure is disclosed. In one embodiment, such a method includes providing a facade comprising an insulating panel and a decorative layer coupled to a front side of the insulating panel. The facade has a substantially planar surface on a back side thereof. The front side of the facade may be non-planar to provide a desired architectural contour to the facade. The method further provides an attachment mechanism on at least one of: (1) the back side of the facade, and (2) an exposed face of a building or other structure. The method attaches the back side of the facade to the exposed face of the building or other structure using the attachment mechanism. A corresponding apparatus and overall assembly are also disclosed herein.

18 Claims, 14 Drawing Sheets

(56) References Cited

U.S. PATENT DOCUMENTS

| | | | | |
|---|---|---|---|---|
| 2005/0076611 | A1* | 4/2005 | Crawford | 52/782.1 |
| 2006/0123723 | A1* | 6/2006 | Weir et al. | 52/302.1 |
| 2006/0277854 | A1* | 12/2006 | Egan | 52/302.3 |
| 2007/0011986 | A1* | 1/2007 | Serino et al. | 52/782.1 |
| 2009/0273302 | A1* | 11/2009 | Staats et al. | 315/297 |
| 2010/0236173 | A1* | 9/2010 | Pacha et al. | 52/309.11 |
| 2011/0078971 | A1* | 4/2011 | Adams | 52/517 |
| 2011/0154764 | A1* | 6/2011 | Wang et al. | 52/309.1 |
| 2011/0197528 | A1* | 8/2011 | Egan et al. | 52/302.1 |
| 2011/0214372 | A1* | 9/2011 | Mullet et al. | 52/309.4 |
| 2012/0174511 | A1* | 7/2012 | Harding | 52/302.1 |
| 2012/0198772 | A1* | 8/2012 | Richardson et al. | 49/197 |
| 2012/0279156 | A1* | 11/2012 | Winteler | 52/506.05 |
| 2013/0125489 | A1* | 5/2013 | Zhou et al. | 52/309.3 |
| 2014/0318068 | A1* | 10/2014 | Jakobsen | 52/506.05 |

* cited by examiner

MODULAR INSULATED FACADE

BACKGROUND

1. Field of the Invention

This invention relates to the construction of buildings and other structures, and more particularly to apparatus and methods for insulating and imparting desired architecture styles to buildings and other structures.

2. Background of the Invention

Modern-day buildings and structures can take on a wide variety of different forms and appearances. Some aspects of a building's form or appearance are functional in nature. Other aspects are purely for aesthetic purposes. Yet other aspects serve both functional and aesthetic purposes. Whether for functional or aesthetic purposes, a significant amount of effort and resources are frequently dedicated to achieving a desired outward form or appearance for a building or structure. Such outward forms and appearances may be based on different architectural designs or styles, such as Gothic, Renaissance, Baroque, Neoclassical, Early Modern, Postmodern, Colonial, Contemporary, or similar designs or styles, to name just a few. Many of these designs or styles use different building materials and architectural elements to achieve their characteristic appearance.

As alluded to above, a large part of the cost of a building or structure may be attributed to achieving a desired appearance. For example, significant time and resources may be dedicated to adding architectural elements to the exterior of a building, or covering the building with overlay materials such as stone, brick, wood, or the like. These architectural elements and overlay materials are frequently applied to buildings in an inefficient and archaic manner. For example, architectural elements and overlay materials may be delivered to a construction site and then manually transported and applied to the outside of a building using scaffolds and other relatively primitive tools. Unfortunately, such techniques fail to take advantage of modern construction and assembly techniques that have driven down prices for many industrial and consumer products, such as cars, machinery, clothing, electronics, and the like.

In view of the foregoing, what are needed are improved construction techniques and building materials for applying architectural elements, overlay materials, and other desired elements to a building or structure. Ideally, such construction techniques and building materials will take advantage of modern construction and assembly techniques commonly used to fabricate industrial and consumer products. Such construction techniques and building materials will also ideally enable a wide variety of different architectural designs and styles to be achieved for buildings and other structures, as well as provide a functional purpose, such as insulate and/or weatherproof buildings and other structures.

SUMMARY

The invention has been developed in response to the present state of the art and, in particular, in response to the problems and needs in the art that have not yet been fully solved by currently available methods and apparatus. Accordingly, improved methods and apparatus have been developed to insulate and impart desired architectural styles to buildings and other structures. Features and advantages of different embodiments of the invention will become more fully apparent from the following description and appended claims, or may be learned by practice of the invention as set forth hereinafter.

Consistent with the foregoing, a method for insulating and imparting a desired architectural style to a building or other structure is disclosed. In one embodiment, such a method includes providing a facade comprising an insulating panel and a decorative layer coupled to a front side of the insulating panel. The facade has a substantially planar surface on a back side thereof. The front side of the facade may be non-planar to provide a desired architectural contour to the facade. The method further provides an attachment mechanism on at least one of: (1) the back side of the facade, and (2) an exposed face of a building or other structure. The method attaches the back side of the facade to the exposed face of the building or other structure using the attachment mechanism. A corresponding apparatus and overall assembly are also disclosed and claimed herein.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

Figure 1:
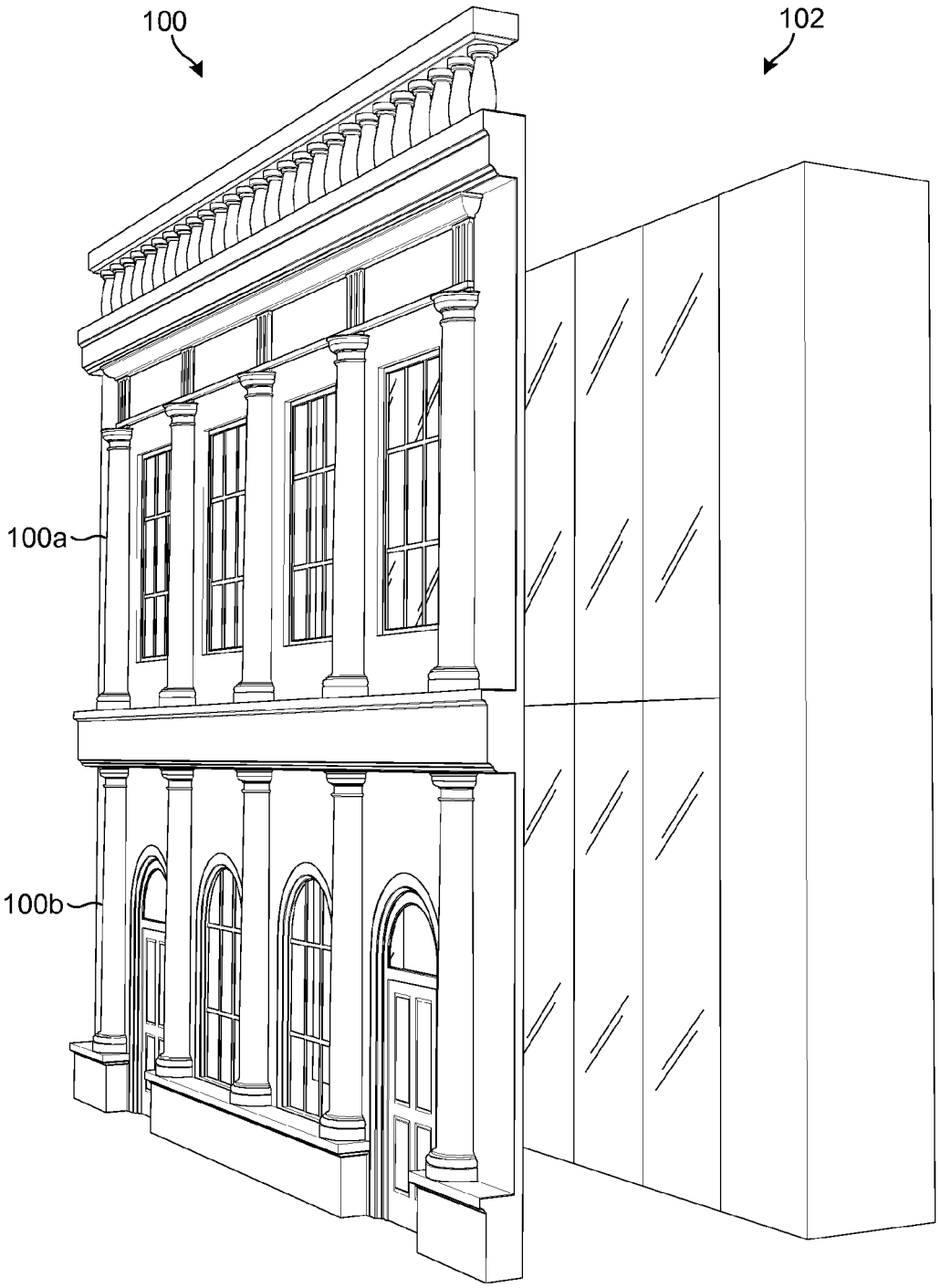
FIG. 1 is a perspective view of one embodiment of modular insulated facade for application to a building or other structure.
Figure 2:
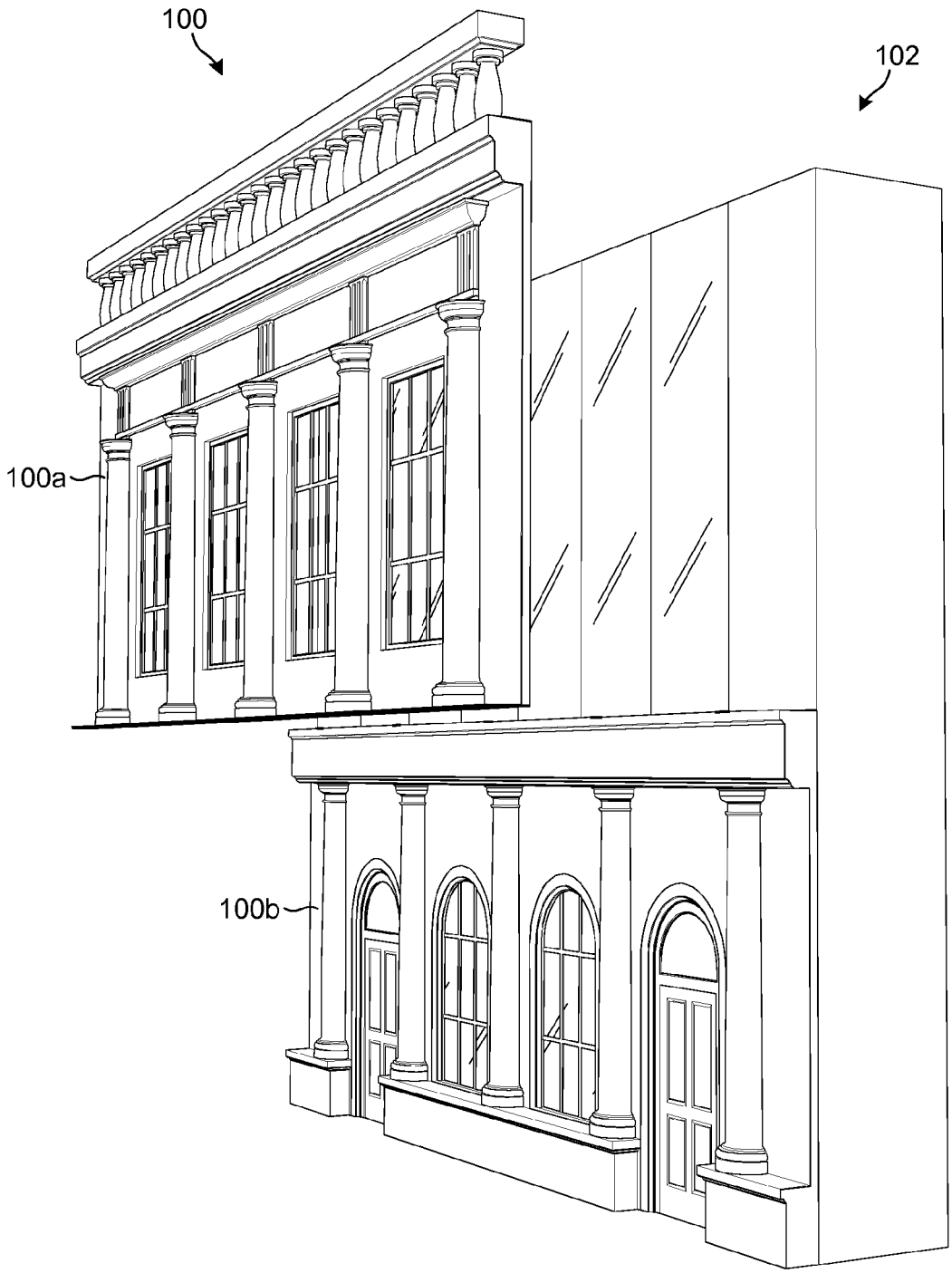
FIG. 2 is a perspective view showing a bottom panel of the modular insulated facade of FIG. 1 applied to a building or other structure.
Figure 3:
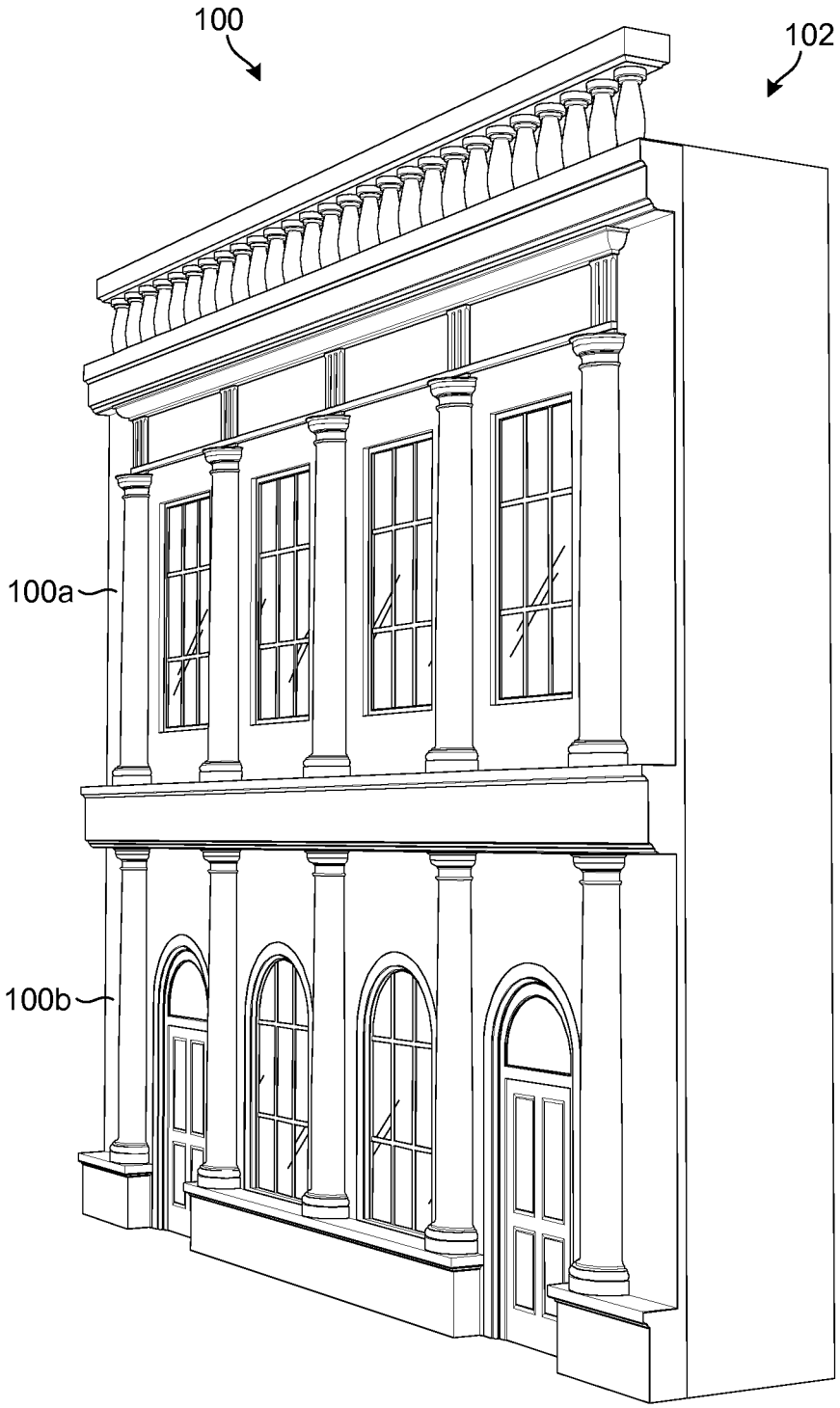
FIG. 3 is a perspective view showing both bottom and top panels of the modular insulated facade of FIG. 1 applied to a building or other structure.

Referring to FIG. 1, a perspective view of one embodiment of a modular insulated facade 100 in accordance with the invention is illustrated. As shown, the modular insulated facade 100 is designed to be applied to a building 102 or other physical structure 102 to impart a desired architectural style thereto. In one embodiment, the modular insulated facade 100 is implemented in the form of modular panels 100*a*, 100*b* for attachment to a building 102 or structure 102. For example, FIG. 2 shows the modular insulated facade 100 with a top panel 100*a* and bottom panel 100*b*, with the bottom panel 100*b* attached to the building 102 or structure 102. FIG. 3 shows both the top panel 100*a* and bottom panel 100*b* attached to the building 102 or structure 102.

Figure 5:
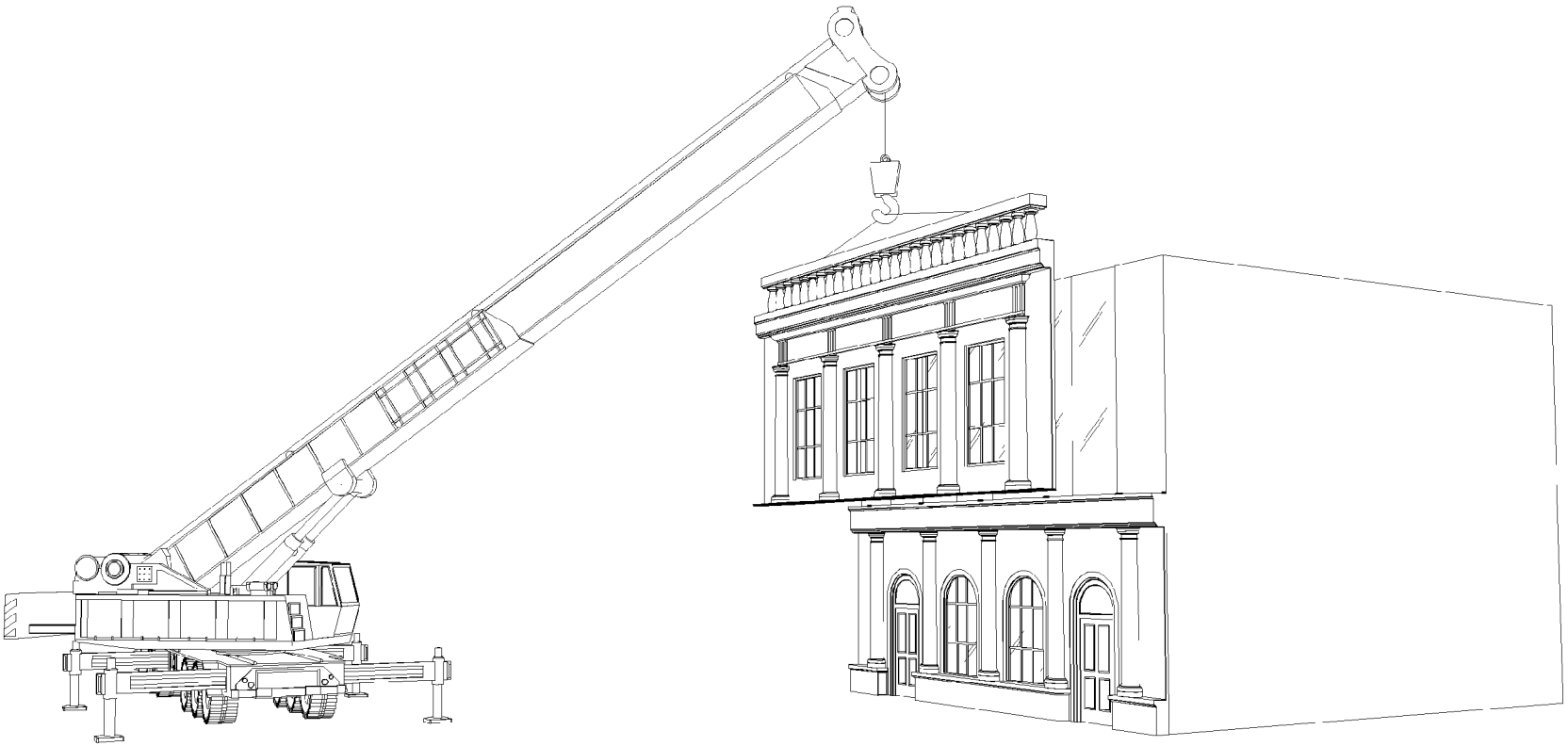
FIG. 5 shows one example of a modular insulated facade in accordance with the invention being installed on a building or other structure.

In certain embodiments, the panels 100*a*, 100*b* are sized to facilitate transport and delivery to a construction site. For example, the panels 100*a*, 100*b* may be sized to fit on a typical semi trailer, railroad car, or other vehicle to facilitate transport. The panels 100*a*, 100*b* may also be sized so that they are easily manipulated and installed on buildings 102 or structures 102 by cranes or other equipment, as shown in FIG. 5, or exclusively using manpower. The size of the modular panels 100*a*, 100*b* may vary in accordance with a project's needs, desired ease of installation, transport restrictions, aesthetic design, and/or the like. The orientation of the modular panels 100*a*, 100*b* may also vary in different embodiments. For example, the horizontally aligned modular panels 100*a*, 100*b* illustrated in FIGS. 1 through 3 may be replaced by vertically aligned modular panels 100*a*, 100*b*, such as modular panels 100*a*, 100*b* extending from top to bottom of a building 102. Joints between the modular panels 100*a*, 100*b* may be placed at any suitable location, such as at floor level, corners, or natural seams or lines in a building 102 or structure 102, in order to reduce their conspicuousness.

Figure 4:
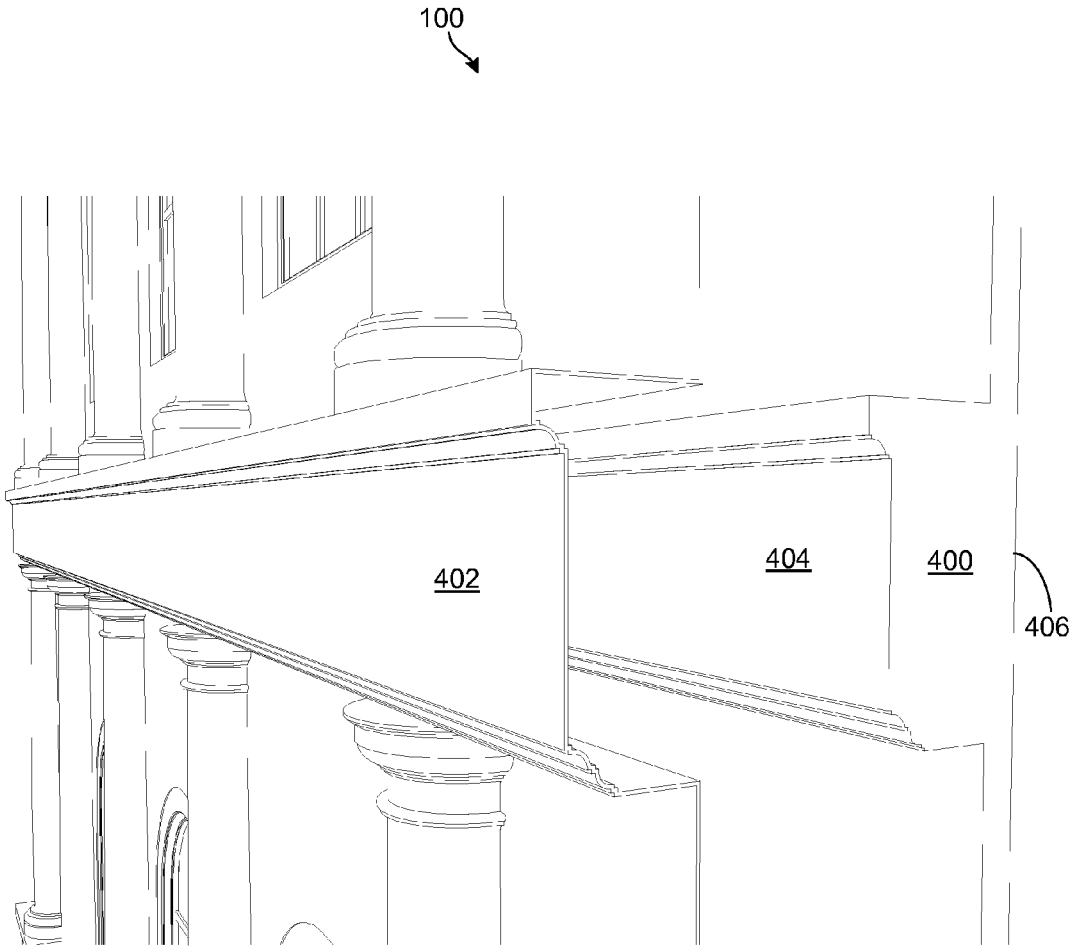
FIG. 4 is a close-up exploded perspective view of the modular insulated facade of FIG. 1.

Referring to FIG. 4, while continuing to refer generally to FIGS. 1 through 3, the modular panels 100*a*, 100*b* discussed above may be generally applied to concrete, metal, wood, and/or glass buildings with substantially planar sides, primarily in applications where the modular panels 100*a*, 100*b* are not required to provide any structural support. In certain embodiments, the modular panels 100*a*, 100*b* are fabricated from insulating panels 400 such as expanded polystyrene (EPS) panels 400 or other insulating foam panels 400. The insulating panels 400 may be solid blocks or may be constructed from multiple blocks that are glued or welded together. A back side 406 of the insulating panels 400 may be substantially flat or planar to interface with a substantially flat or planar building 102 or structure 102. A front side 404 of the insulating panels 400 may be shaped to provide a desired architectural style. This shape may be achieved by milling the insulating panels 400 using a CNC mill or other milling equipment. It is also contemplated that the shape may be achieved using a mold or a 3-D printer configured to lay down insulating material in a desired shape or pattern.

The insulating panels 400 may be coated or covered with one or more layers (collectively referred to herein as a "decorative layer" 402). In certain embodiments, the decorative layer 402 includes a base layer such as glass-fiber reinforced concrete, fiberglass, epoxy, plastic, polymers (e.g., polyurethane), stucco, or the like. The base layer may be applied to the insulating panels 400 by spraying, brushing, rolling, dipping, or using various deposition techniques. The base layer may provide one or more of impact resistance, corrosion resistance, rigidity, a barrier to moisture/weather, as well as provide a layer onto which other layers may be adhered. A finish layer, such as paint or stain may be applied onto or over the base layer. This finish layer may also be applied by spraying, brushing, rolling, dipping, or using various deposition techniques. Various intermediate layers (e.g., primers, etc.) may be used between the base layer and the finish layer.

Overlay materials, such as stone, brick, wood, vinyl, metal, moldings, castings, architectural elements, or the like, may be applied over the base layer. Ideally, such overlay materials, particularly weighty overlay materials, are applied thinly to keep the modular insulated facade 100 as light weight as possible while still providing a desired appearance. Although insulating materials such as EPS foam are typically very lightweight, coatings, finishes, and overlay materials can add a significant amount of weight to the modular panels 100*a*, 100*b*. Thus, these coatings, finishes, and overlay materials may be kept as thin and lightweight as possible to minimize the additional weight. Intermediate layers, such as vapor barriers, wind/moisture barriers, sheathing, metal lath or mesh, mortar scratch coats, mortar setting beds, felt paper, and/or the like, may be used depending on the application.

As mentioned above, a back side 406 of the modular insulated facade 100 may be substantially flat or planar to facilitate installation on a wide variety of buildings 102 or structures 102. All that is needed is a substantially flat exposed surface on the building 102 or structure 102 to install the modular insulated facade 100. Because the modular insulated facade 100 is designed to be lightweight, the modular insulated facade 100 may, in certain embodiments, be coupled to a building 102 or other structure 104 with nothing more than an adhesive. In certain embodiments, an adhesive is applied to the modular insulated facade 100 at the factory and covered with a paper cover seal. This paper cover seal may be removed at the construction site and the modular insulated facade 100 may be adhered to the building 102 or structure 102. Alternatively, or additionally, an adhesive may be applied to the modular insulated facade 100 and/or the building 102 or structure 102 at the construction site.

Attachment of the modular insulated facade 100 to a building 102 or structure 102 is not limited to adhesives. In certain embodiments, mechanical fasteners, such as screws, bolts, hooks, rivets, brackets, or the like may be used on their own or in conjunction with an adhesive to attach the modular insulated facade 100 to a building 102 or structure 102. In other embodiments, an overhang or lip may be provided at or near a top of the modular panels 100*a*, 100*b*. This overhang or lip may hook onto or rest on a top edge of a building 102 or structure 102, or hook onto or rest on a rail attached to a building 102 or structure 102. Other types of mechanical attachments are possible and within the scope of the invention. Mechanical attachments such as fasteners may be attached to the modular panels 100*a*, 100*b* at the factory or installed at the construction site.

In certain embodiments, an attachment mechanism may be selected to facilitate removal of the modular insulated facade 100. For example, where an adhesive is used, a hot wire may be used to cut or melt the adhesive to enable removal of the modular insulated facade 100 from a building 102 or structure 102. Mechanical fasteners may also be selected that are removable or capable of releasing their mechanical attachment. In certain cases, a modular insulated facade 100 may be removed from a building 102 or structure 102 so that it can be replaced with another modular insulated facade 100 either of the same or a different architectural style. A modular insulated facade 100 may also be removed from a building 102 or structure 102 to facilitate repair and reinstallation.

As shown in FIGS. 1 through 3, in certain embodiments, a modular insulated facade 100 in accordance with the invention may include openings such as windows or doors. Modular panels 100*a*, 100*b* that include window openings may, in certain embodiments, be applied to glass walls or panels on a building 102 or structure 102. The instant inventors have found that glass is one of the most cost-effective building materials with which to construct the walls of a building 102 or structure 102. Installing modular panels 100*a*, 100*b* with window openings over glass or transparent walls may be used to create different types, shapes, and styles of windows. Window shapes, styles, and sizes may be changed by replacing a modular insulated facade 100 with another modular insulated facade 100 having different window openings. The glass, which is part of the building 102 or structure 102 as opposed to the modular insulated facade 100, may be used with different types and styles of modular insulated facades 100. The modular insulated facade 100 may control which portions and areas of glass are exposed to the exterior of the building 102 or structure 102. In addition to allowing a wide variety of window designs to be achieved, implementing windows using the modular insulated facade 100 advantageously eliminates or substantially reduces cracks, leaks, and/or drafts associated with traditional windows (since the glass is a continuous panel from floor to ceiling as opposed to a number of discrete panels), potentially increasing the energy efficiency of a building 102 or structure 102.

As previously explained, the modular panels 100*a*, 100*b* may be fabricated from insulating panels 400. Thus, the modular insulated facade 100 may provide thermal insulation for a building 102 or structure 102 in addition to providing a desired aesthetic appearance. This eliminates or reduces the need to separately insulate the building 102 or structure 102. In certain embodiments, the thickness and material of the insulating panels 400 may be selected to provide a desired R-value. For example, common residential code requires exterior walls to be a minimum R-21. One type of EPS foam that may be used as an insulating panel 400 is rated at R-5 per inch. Using this type of foam, the minimum thickness for the foam would be just over four inches.

Due to the modular design of the panels 100*a*, 100*b*, modern construction and assembly technique may be used to reduce the cost of a building 102 or structure 102. For example, the modular panels 100*a*, 100*b* may be constructed in a factory and transported to a construction site ready for installation. Among other benefits, this construction method may reduce $CO_2$ emissions resulting from transporting materials and workers to and from a construction site, reduce emissions and environmental impacts from construction operations, minimize waste materials that may be reused and recycled in a factory setting, improve scheduling required to complete a building 102 or structure 102, improve worker safety, improve quality of the finished product, etc. All of the efficiencies, cost-savings, and benefits associated with factory-based fabrication may help to reduce the overall cost and environmental impact of a building 102 or structure 102.

In certain embodiments, structural members may be incorporated into the modular insulated facade 100 to impart additional rigidity, strength, or impact resistance thereto. For example corners or edges of the insulating panels 400, or architectural elements on or attached to the insulating panels 400, may be covered with or lined with metal or plastic beads to prevent dents, dings, or other damage. In other embodiments, metal studs or other structural members may be incorporated into the insulating panels 400 or into architectural shapes or elements on the insulating panels 400 to provide additional rigidity or strength to the insulating panels 400 and/or elements attached thereto. These studs or structural members may be incorporated into grooves or channels formed in the insulating panels 400, or embedded in the insulating foam of the panels 400 at the time of creation.

After the modular panels 100*a*, 100*b* are installed on a building 102 or structure 102, edges or seams between the modular panels 100*a*, 100*b* may be caulked or sealed, such as with expanding polyurethane-based insulating foam or other sealing agents. This will ideally provide an air- and/or water-tight seal between the modular panels 100*a*, 100*b* and/or between the modular panels 100*a*, 100*b* and the building 102 or structure 102. This will ideally improve the overall thermal insulation and energy efficiency of the building 102 or structure 102 and reduce paths for insects, water, etc. The instant inventors anticipate a clearance gap of approximately ⅛ inch between modular panels 100*a*, 100*b*, a gap that may be filled with various types of caulks and sealants.

Figure 6:
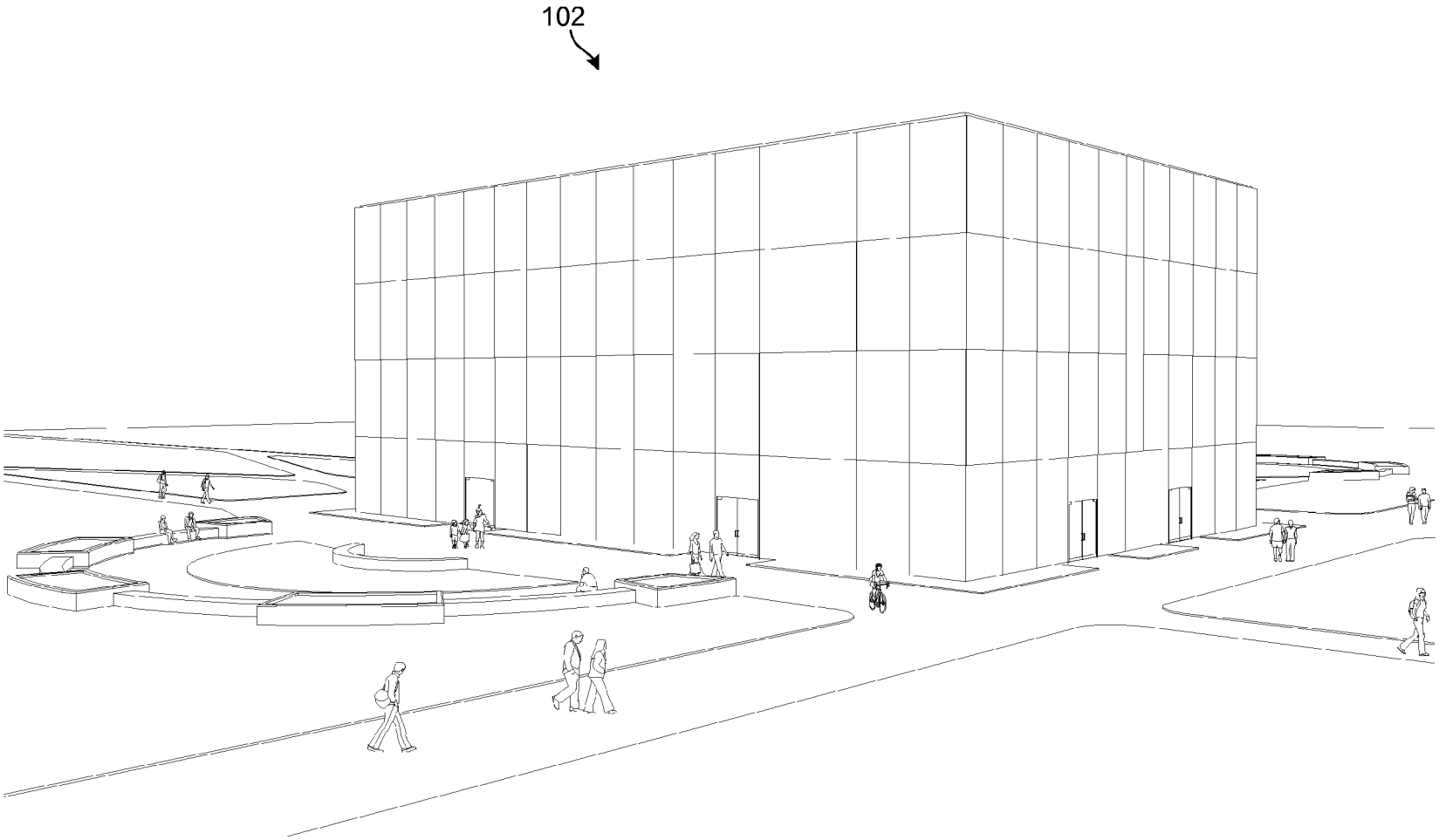
FIG. 6 shows one example of a simple or standardized building, such as a glass and/or concrete building, prior to applying a modular insulated facade in accordance with the invention.
Figure 7:
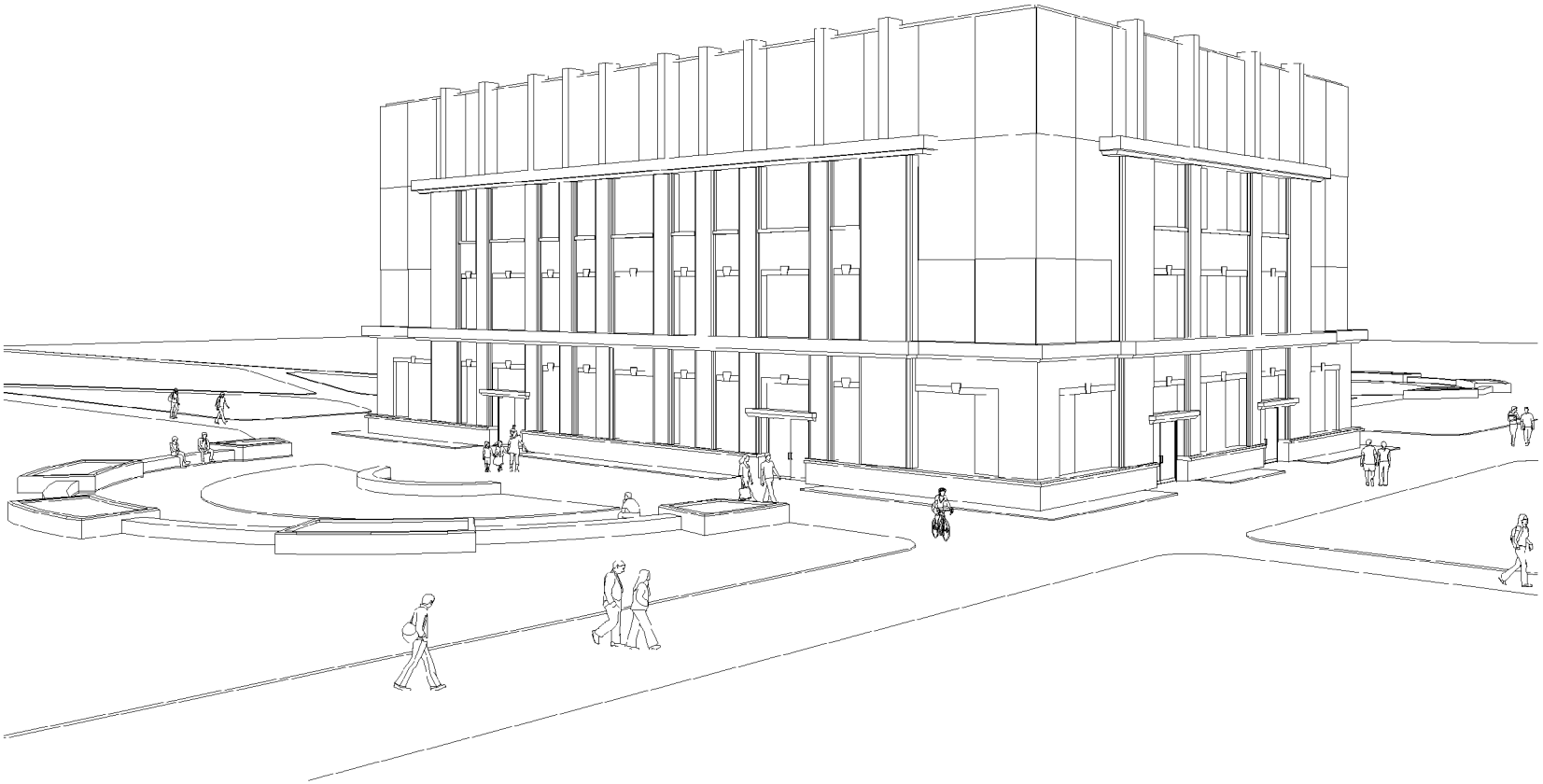
FIG. 7 shows a first example of a modular insulated facade applied to the building of FIG. 6.
Figure 8:
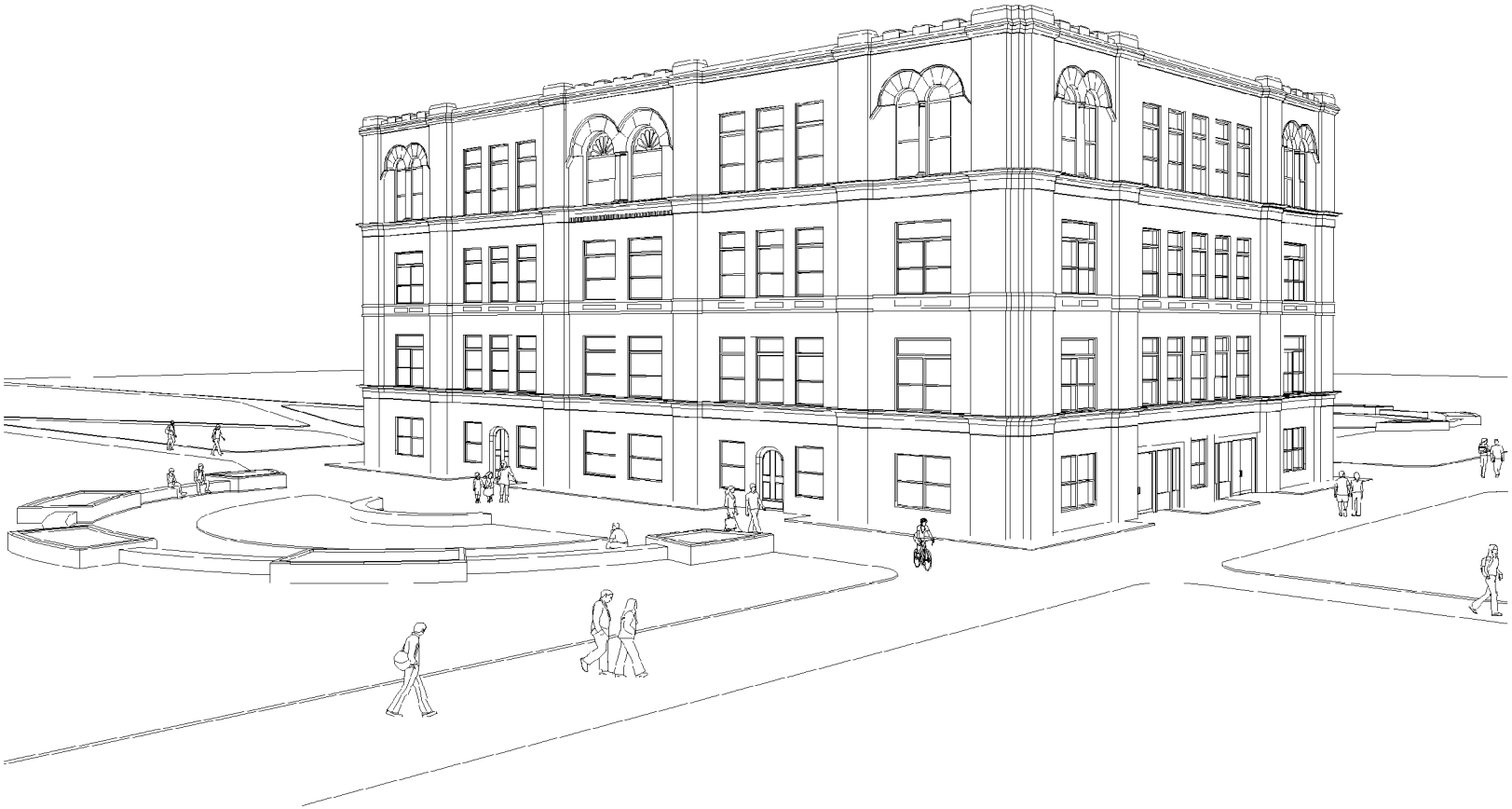
FIG. 8 shows a second example of a modular insulated facade applied to the building of FIG. 6.
Figure 9:
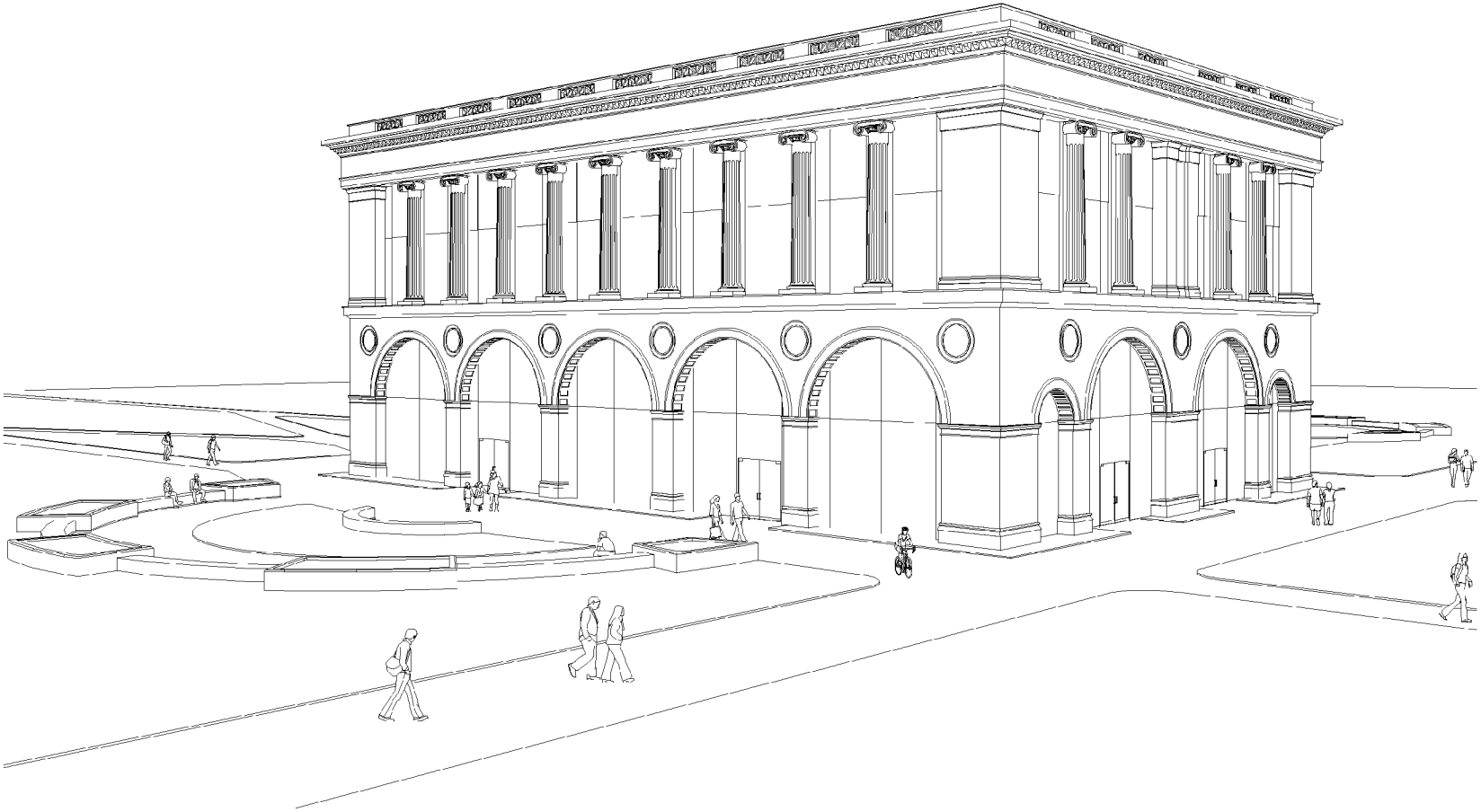
FIG. 9 shows a third example of a modular insulated facade applied to the building of FIG. 6.
Figure 10:
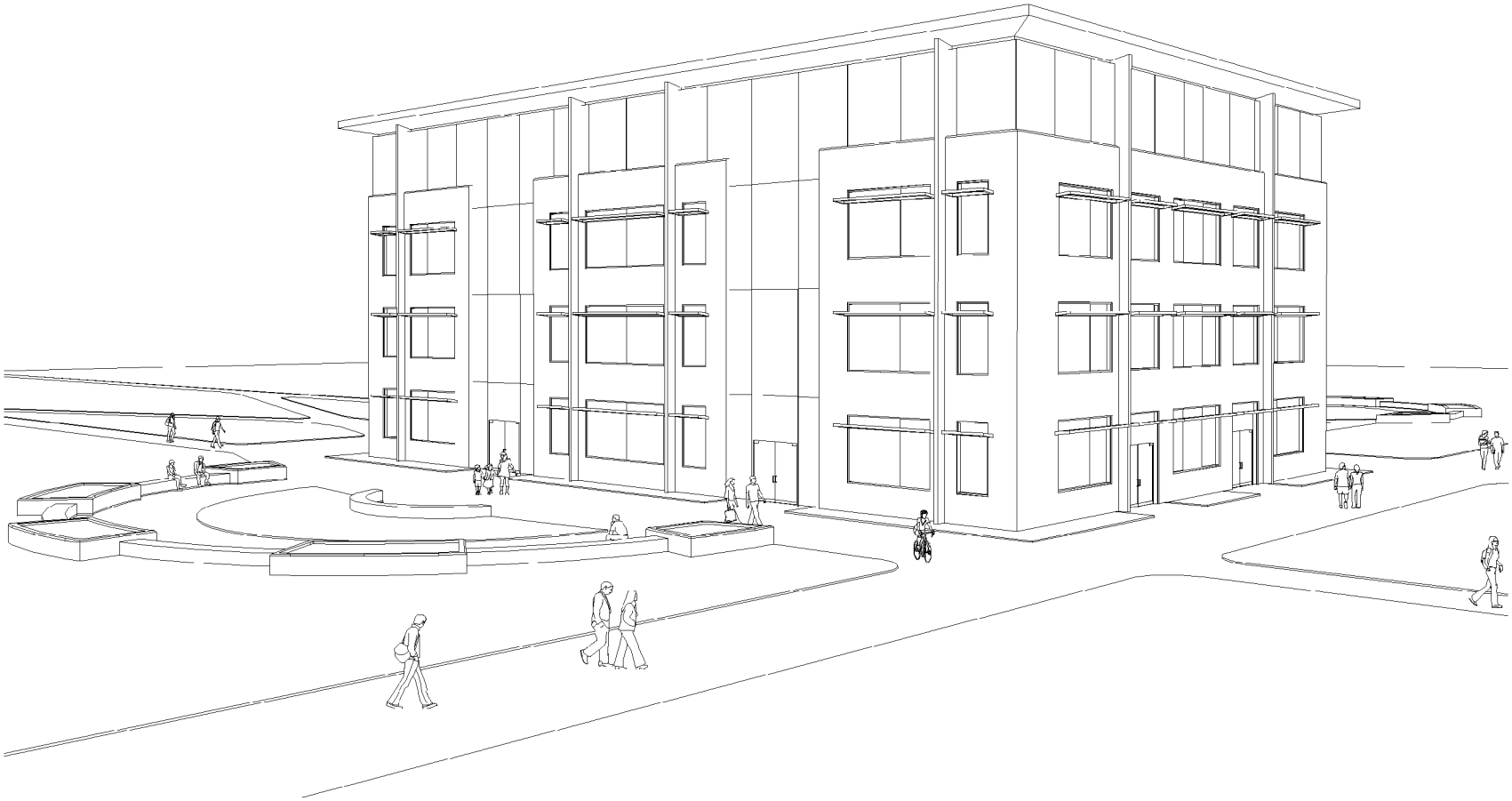
FIG. 10 shows a fourth example of a modular insulated facade applied to the building of FIG. 6.
Figure 11:
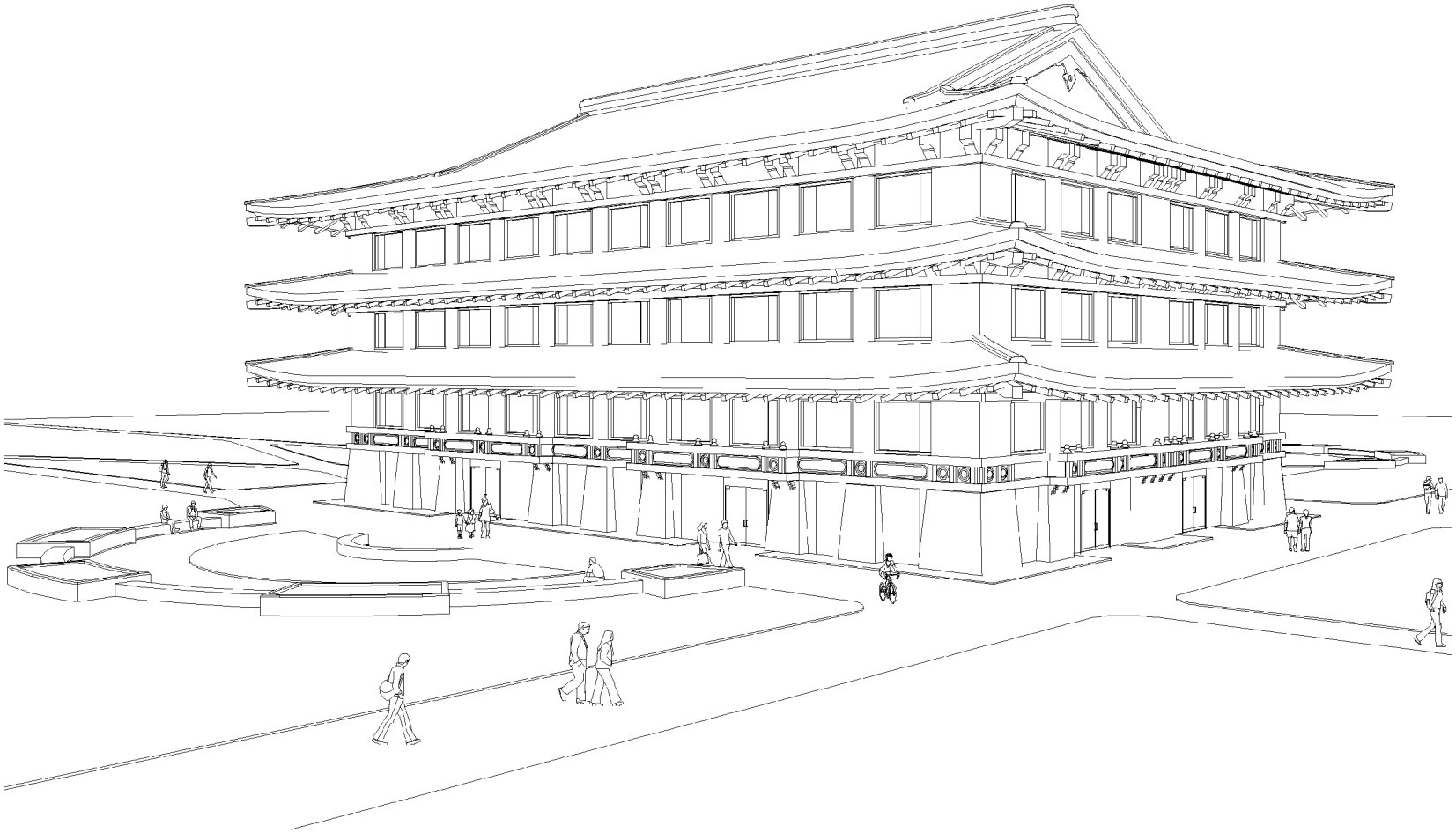
FIG. 11 shows a fifth example of a modular insulated facade applied to the building of FIG. 6.

As can be appreciated, a wide variety of different architectural styles are possible using the disclosed modular insulated facade system, various examples of which are illustrated in FIGS. 7 through 11. The disclosed modular insulated facade system may be used to transform a comparatively simple or standardized building, such as the building 102 illustrated in FIG. 6, into any of the buildings 102 illustrated in FIGS. 7 through 11. The modular insulated facade system may enable the styling of a building 102 to change by simply removing the previous modular insulated facade 100 and replacing it with a new modular insulated facade 100 having a desired architectural style. The modular insulated facade 100 also has the potential to significantly reduce the costs of constructing buildings 102 and other structures 102. For example, instead of designing a building 102 from scratch, a basic or standardized concrete and/or glass building may be transformed into a building 102 with a distinct architectural style.

Using the disclosed modular insulated facade system, a wide variety of different architectural elements are possible. For example, the disclosed modular insulated facade system may be used to replicate columns, arches, crown molding, siding, cornices, gables, posts, pilasters, eaves, soffits, windows, and dormers, to name just a few. The surface of the modular insulated facade 100 may also be shaped, textured, and/or colored to look like brick, stone, logs, wood, or other materials. In addition to being useful in the construction of buildings 102 such as residential dwellings, commercial buildings, government buildings, public buildings, schools, multi-purpose units, and the like, the disclosed modular insulated facade system may be equally useful in the construction of movie sets, theme parks, stage backdrops, sound walls, landscaping, and the like.

The disclosed modular insulated facade 100 is not limited to covering exterior walls of a building 102 or structure 102.

Figure 12:
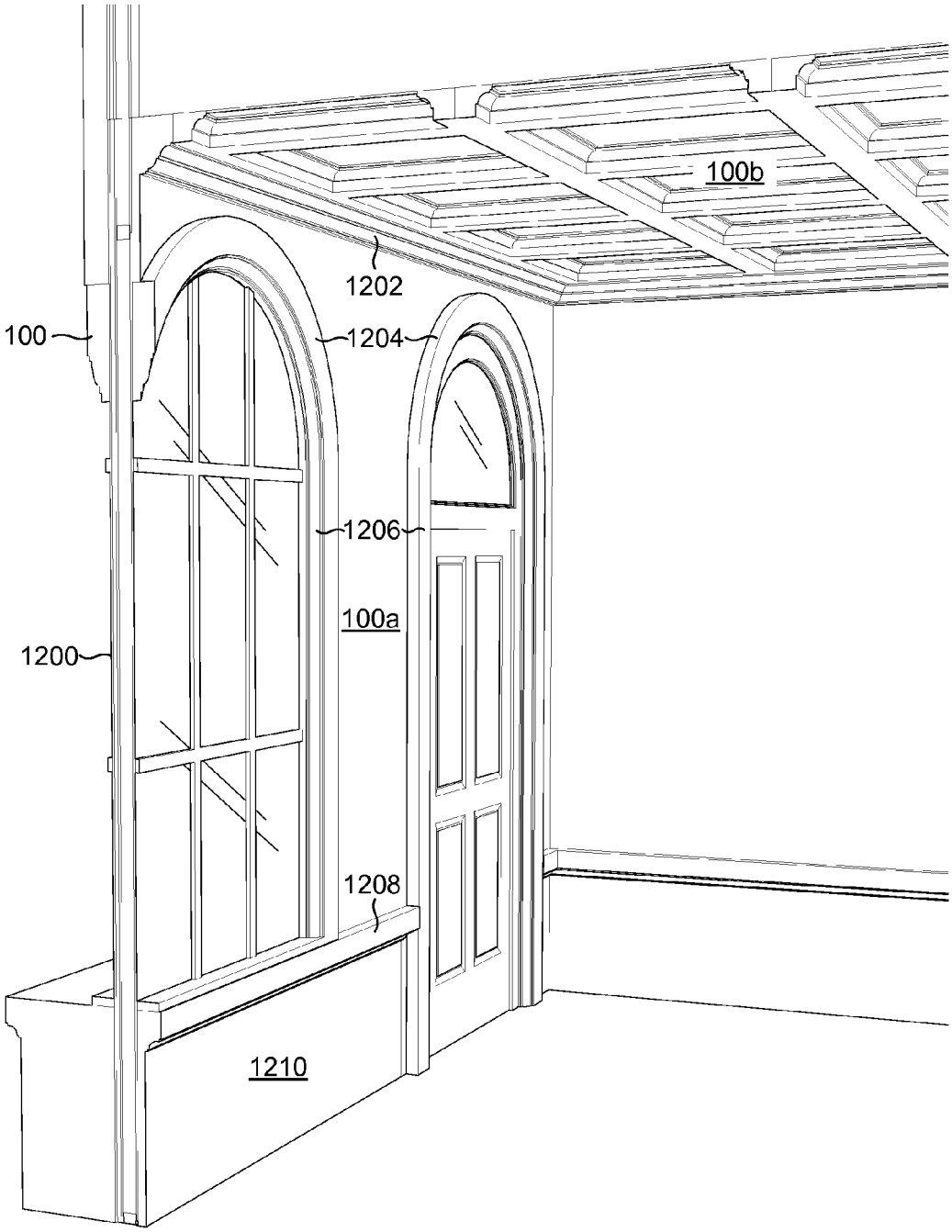
FIG. 12 shows one example of modular insulated facades used on interior walls and a ceiling of a building.

In certain embodiments, the same type of system may be used to cover interior walls, ceilings, and even roofs of buildings 102 or structures 102. FIG. 12 shows one example of a modular insulated facade 100*a* used on interior walls of a building 102. As shown, the modular insulated facade 100*a* includes window and door opening that align with corresponding window and door openings of an exterior modular insulated facade 100. In the illustrated embodiment, a glass panel 1200 resides between the interior modular insulated facade 100*a* and the exterior modular insulated facade 100. The interior and exterior modular insulated facades 100, 100*a* control which portions and areas of the glass panel 1200 are exposed to the inside and outside of the building, respectively. As also shown in FIG. 12, the interior modular insulated facade 100*a* includes architectural elements, namely crown molding 1202, an arched window and door 1204, window and door trim 1206, chair rail 1208, and panels/baseboards 1210 beneath the chair rail 1208. These represent just a few examples of architectural elements that are possible using the disclosed modular insulated facade 100. Other architectural elements are possible and within the scope of the invention.

Figure 13:
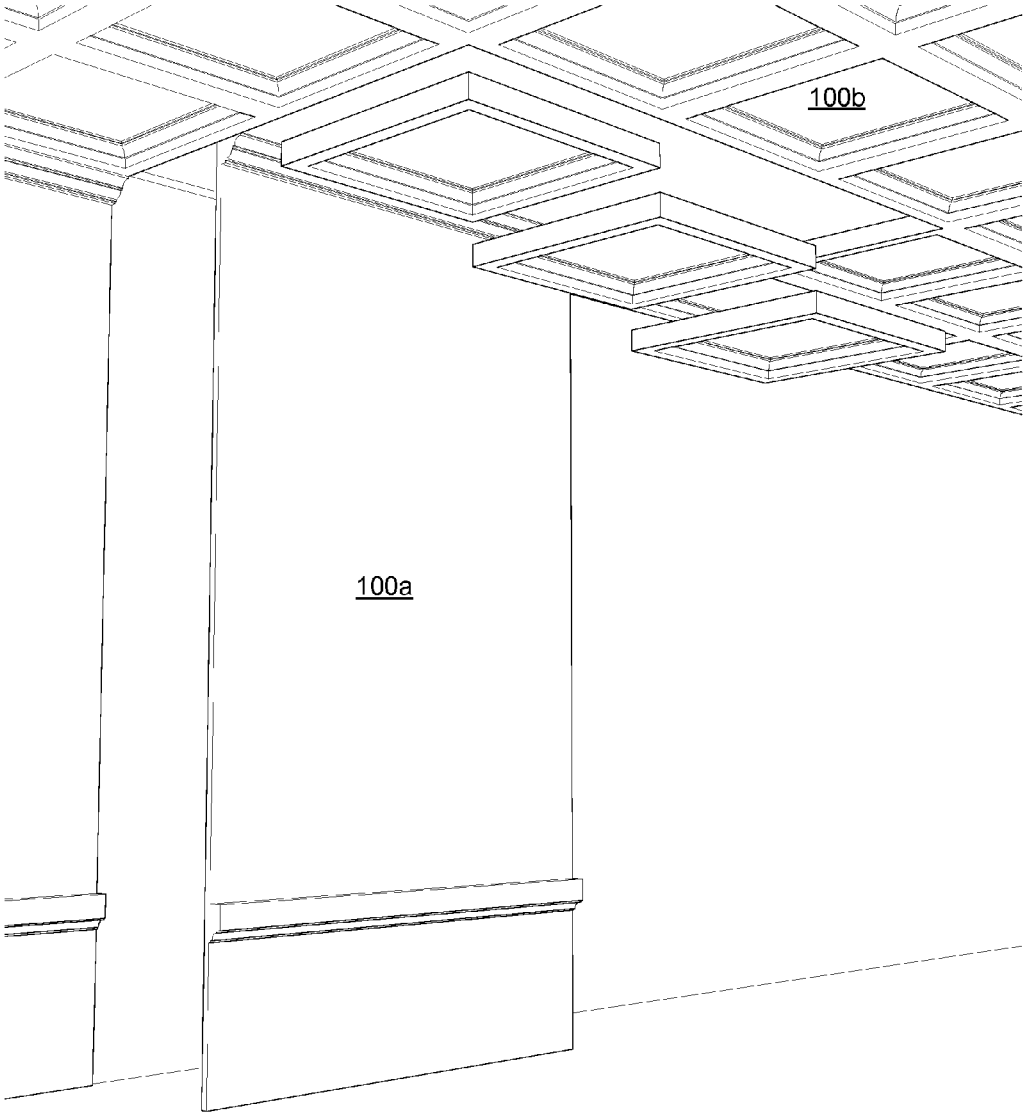
FIG. 13 shows another example of modular insulated facades used on interior walls and a ceiling of a building.
Figure 14:
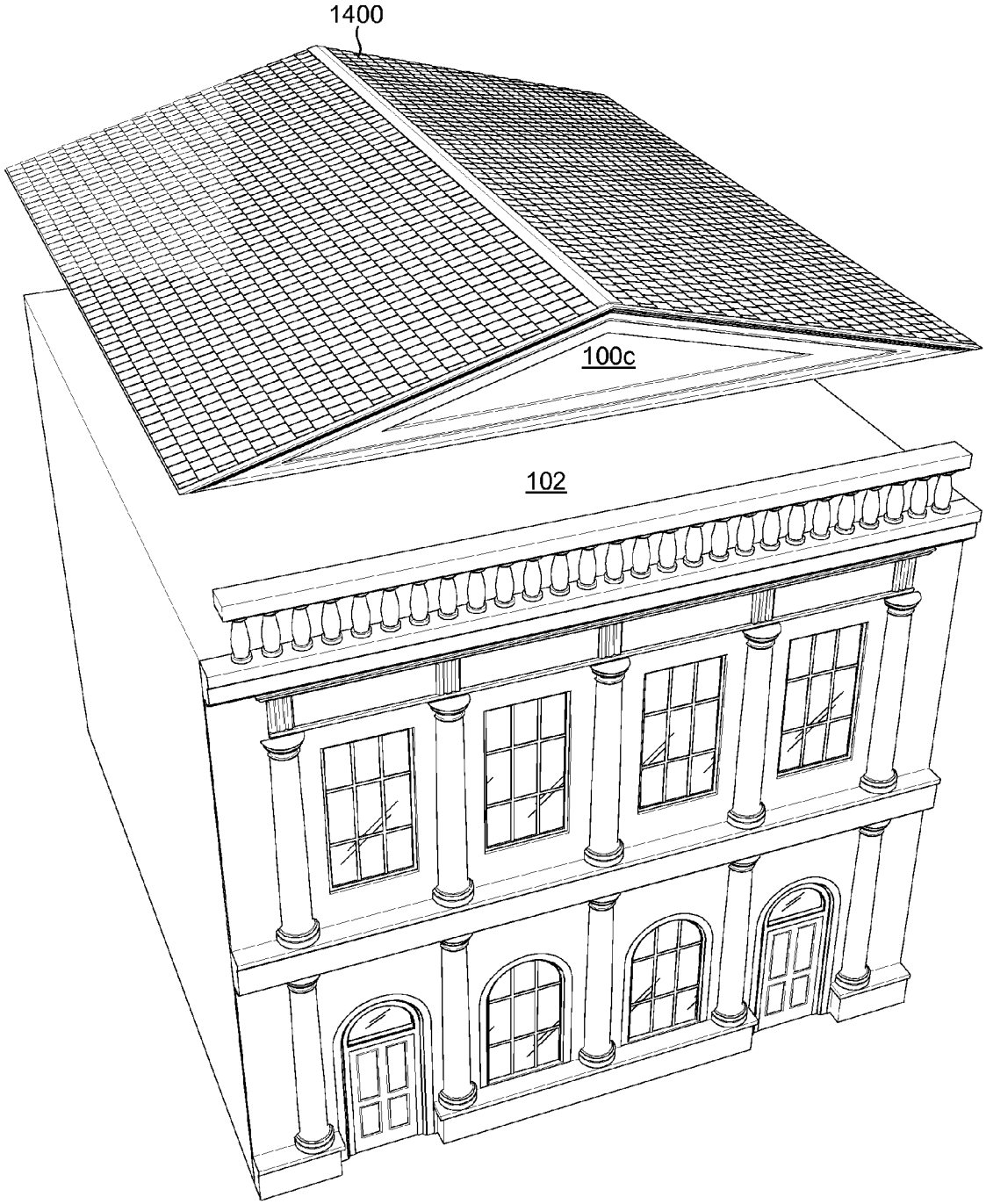
FIG. 14 shows an example of a modular insulated facade used as or on a roof of a building.

As further shown in FIG. 12, a modular insulated facade 100*b* in accordance with the invention may, in certain embodiments, also be used in ceiling panels. A large number of different designs and architectural styles are possible. The light-weight construction of the modular insulated facade 100*b* may be particularly useful for ceiling panels since the panels would be suspended and any attachment mechanism must hold their full weight. The light-weight construction of the modular insulated facade 100*b* may reduce the robustness required for the attachment mechanism and may improve safety for those passing under the panels. FIG. 13 shows another example of modular insulated facades 100*a*, 100*b* used on interior walls and ceiling panels.

In other embodiments, a modular insulated facade 100*c* in accordance with the invention may be used as a roof 1400 of a building 102 or structure 102. In certain embodiments, additional structural members may be incorporated into the modular insulated facade 100*c* to provide necessary strength and rigidity in roof applications. Various types of roofing materials may be overlaid on the modular insulated facade 100 to provide a desired appearance and/or protection from natural elements such as wind, water, etc.

The apparatus and methods disclosed herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A method of insulating and imparting a desired architectural style to a transparent wall of a building made of a transparent material, the method comprising:

providing a facade comprising an insulating panel and a decorative layer that coats a front side of the insulating panel, wherein a back side of the insulating panel is substantially planar, and the front side of the insulating panel provides protruding three-dimensional architectural elements which impart the desired architectural style to the transparent wall of the building;

providing an attachment mechanism on at least one of: (1) a back side of the facade, and (2) an exposed face of the transparent wall of the building; and attaching the back side of the facade to the exposed face of the transparent material of the transparent wall of the building using the attachment mechanism.

2. The method of claim 1, wherein the insulating panel is fabricated from insulating foam.

3. The method of claim 1, wherein the protruding three-dimensional architectural elements comprise at least one of columns, moldings, arches, window moldings, cornices, posts, pilasters, eaves, soffits, arches, bricks, stones, wood, and dormers.

4. The method of claim 1, wherein the exposed face is an exposed face of a structural building material.

5. The method of claim 1, wherein the facade comprises at least one opening to enable light to pass through the facade and the transparent wall of the building.

6. The method of claim 1, wherein the attachment mechanism comprises an adhesive.

7. The method of claim 1, wherein the attachment mechanism comprises a mechanical attachment mechanism.

8. The method of claim 1, wherein a thickness of the insulating panel is designed to provide at least an R-21 insulation value.

9. The method of claim 1, wherein the facade further comprises structural members to impart additional strength and rigidity thereto.

10. An apparatus that insulates and imparts a desired architectural style to a transparent wall of a building made of a transparent material, the apparatus comprising:

a facade comprising an insulating panel and a decorative layer that coats a front side of the insulating panel, wherein a front side of the insulating panel provides protruding three-dimensional architectural elements which impart the desired architectural style to the transparent wall of the building, and a back side of the insulating panel is substantially planar and attaches to an exposed face of the transparent material of the transparent wall of the building.

11. The apparatus of claim 10, wherein the insulating panel is fabricated from insulating foam.

12. The apparatus of claim 10, wherein the protruding three-dimensional architectural elements comprise at least one of columns, moldings, arches, window moldings, cornices, posts, pilasters, eaves, soffits, arches, bricks, stones, wood, and dormers.

13. The apparatus of claim 10, wherein the facade comprises at least one opening to enable light to pass through the facade and the transparent wall of the building.

14. The apparatus of claim 10, further comprising an adhesive on the back side of the insulating panel.

15. The apparatus of claim 10, wherein a thickness of the insulating panel is designed to provide at least an R-21 insulation value.

16. The apparatus of claim 10, wherein the facade further comprises structural members to impart additional strength and rigidity thereto.

17. An assembly comprising:

a transparent wall of a building made of a transparent material comprising an exposed face;

a facade attached to the exposed face of the transparent wall of the building, the facade comprising an insulating panel and a decorative layer that coats a front side of the insulating panel, wherein the front side of the insulating panel provides protruding three-dimensional architectural elements, and a back side of the insulating panel is substantially planar and attaches to the exposed face of the transparent material of the transparent wall of the building.

18. The assembly of claim 17, wherein the facade comprises at least one opening to enable light to pass through the facade and the transparent wall of the building.

* * * * *